United States Patent [19]

Klepper et al.

[11] 4,449,896

[45] May 22, 1984

[54] HYDRAULIC OPERATED SURFACE PUMPING UNIT

[75] Inventors: Robert Klepper, Arvada; Daryld W. Bomar, Littleton, both of Colo.

[73] Assignee: Energy 2000, Inc., Golden, Colo.

[21] Appl. No.: 302,158

[22] Filed: Sep. 14, 1981

[51] Int. Cl.[3] ..... F04B 47/04

[52] U.S. Cl. ..... 417/399; 60/369; 91/306; 91/307; 91/415

[58] Field of Search ..... 417/398, 399; 60/369, 60/370, 371, 372; 91/305, 306, 307, 415; 165/38; 123/41.1, 41.27, 41.54

[56] References Cited

U.S. PATENT DOCUMENTS

| | | | |
|---|---|---|---|
| 3,175,513 | 3/1965 | Dulaney | 417/399 X |
| 3,212,406 | 10/1965 | McDuffie | 417/403 |
| 3,292,598 | 12/1966 | Miller et al. | 165/38 |
| 3,360,304 | 12/1967 | Adams et al. | 91/415 X |
| 3,540,349 | 11/1970 | Pennther | 91/306 |
| 3,604,884 | 9/1971 | Olsson | 91/415 |
| 3,939,656 | 2/1976 | Goldfein | 60/444 X |
| 3,971,213 | 7/1976 | Kelley | 60/372 |
| 4,116,268 | 9/1978 | Kruger | 123/41.54 X |
| 4,191,016 | 3/1980 | Roth et al. | 60/371 |
| 4,209,062 | 6/1980 | Woodhull, Jr. | 165/38 |

FOREIGN PATENT DOCUMENTS

| | | | |
|---|---|---|---|
| 45-10857 | 4/1970 | Japan | 91/463 |

OTHER PUBLICATIONS

Wolansky, W. D.; Nagohosian, J.; Henke, R. W.; Fundamentals of Fluid Power; Houghton Mifflin Co.; Boston; 1977, pp. 240, 241.

*Primary Examiner*—Leonard E. Smith
*Attorney, Agent, or Firm*—Young & Martin

[57] ABSTRACT

The hydraulic operated surface pumping unit of this invention is a counterbalanced cross beam type pumping unit driven by a hydraulic cylinder. The pumping unit can be operated in a first mode of equal upstroke and down stroke speeds or in a second mode of slower upstroke and faster down stroke speeds. The stroke lengths are controlled by cams and are adjustable over a large range. Stroke cycle speeds can be varied by adjusting the output rate of a hydraulic pump used to drive the system. The main hydraulic valve includes intermediate lock positions to hold the pumping unit steady during phase shifts between upstrokes and down strokes and during shut down of the pumping unit. Pressure indicators are provided for optimum counterbalancing of the pumping unit, and a needle valve control for return fluid flow to tank is provided for slow let down of the pump rod for initial tag out settings. A combination oil tank and cooling unit has an overflow bypass to insure the hydraulic pump is not starved of hydraulic fluid in cold weather start up.

29 Claims, 6 Drawing Figures

HYDRAULIC OPERATED SURFACE PUMPING UNIT

BACKGROUND

The present invention is related to surface pumping units for deep wells, such as oil wells, and more specifically to hydraulically operated surface pumping units for lifting and lowering pump rods of cylinder pumps in deep wells.

When deep wells, such as oil wells, have insufficient reservoir pressure to drive the formation fluid to the surface of the ground, the wells must be pumped. A variety of pumps are in common use for pumping reservoir fluid to the surface, including down hole turbine pumps, gas lift pumps, vacuum pumps and the like, depending to a large extent on depth, volume flow rates, and other economic as well as aesthetic considerations. However, the most common type of pump used in the past and still used at the present time is a conventional reciprocating piston cylinder or barrel pump. In this type of pump, a cylinder with a piston therein is positioned down hole below the fluid level in the well. Reciprocal vertical movement of the piston up and down in the cylinder, in combination with appropriate check valves, pumps the fluid in the well to the surface of the ground. When using a down hole cylinder or barrel pump therefore, it is necessary to provide a drive mechanism for reciprocating the piston up and down in the pump cylinder. In the conventional manner of driving such pumps, a pump rod is extended downwardly in the well casing from the surface of the ground with the lower end of the pump rod string attached to the piston in the pump cylinder. A drive apparatus capable of moving the pump rod up and down in reciprocal motion is then attached to the pump rod at the well head at the surface of the ground. Such drive apparatus are called surface pumping units.

The most commonly used surface pumping units are in the form of counterbalance cross beam pumps which utilize a large horizontal cross beam pivotally mounted on a frame. The cross beam is driven to rock in an oscillating upstroke and down stroke motion in a vertical plane. The surface end of the pump rod string is attached to one end of the cross beam so that the oscillating motion of the cross beam pulls the pump rod up and lets it down in reciprocal motion. In conventional cross beam surface pumping units the cross beam is usually oscillated by a motor driven crank wheel with a connecting rod extending between an eccentric connection to the crank wheel and the cross beam. The motor or engine used to drive the pump is commonly connected to the crank wheel with gears, chains, belts, or the like. These conventional cross beam surface pumping units are commonly called horse head pumps due to the appearance of the cable mount and guideplate on the end of the cross beam. In order to offset the weight of the pump rod string hanging from one end of the cross beam, the surface pumping units are counterbalanced for smoother operation by hanging counter weights on the opposite end of the cross beam or by attaching eccentric weights on the crank wheel or both.

Such conventional pumps have in the past and still are widely used in the industry and generally perform well. However, there are a number of problems associated with the use of such surface pumping units that have not heretofore been solved. For example, the gear boxes, belts, chains or pulleys used to drive the surface pumping units are in constant need of maintenance and repair and can become particularly troublesome in adverse climatic conditions, such as extreme cold or extreme heat. Counterbalancing has also always been a difficult precedure on such surface pumping units. Installation of a rod dynamometer is usually required, and it is very difficult to avoid hammering the piston of down hole well pump on the bottom of the cylinder during such counterbalancing and initial set-up operations. These problems have become more significant in deep well applications, such as in oil wells 10,000 to 15,000 feet deep. In wells of such depth, the pump rods are very long and heavy, and elastic yield and stretch in the pump rod between the surface and the bottom make it very difficult if not impossible to calculate or predict accurately the relative position of the piston in the cylinder in the down hole pump at any time during the reciprocating phases of the pump cycle.

Other problems associated with the use of conventional surface pumping units include little or no flexibility for varying the up and down stroke lengths or speeds. Also, the desired pumping perameters vary significantly among different formation characteristics of the oil reservoirs. For example, some reservoirs are conducive to very high volume oil flow so fast stroke cycles can be used. Others are relatively impermeable and oil flow is slow pumping so slower pumping and maximum open barrel dwell time is required. In reservoirs where salt water or other undesirable fluids are close to the oil bearing strata, it is often necessary to pump in long slow strokes to avoid drawing salt water into the well. On the other hand where significant amounts of salt water in the produced oil cannot be avoided, it is often desirable to pump the well at a higher rate to produce sufficient fluid to meet quotas allowed for the well. Since conventional surface pumping units have the disadvantage of operating at one unitary speed in both the up and down strokes, such varying conditions are difficult to accomodate.

A relatively recent development in surface pumping units is the use of hydraulic cylinders mounted directly over the well head and connected to the pump rod for pulling the pump rod up and allowing it to fall down again. Such "pedestal" surface pumping units have advantages, such as eliminating large equipment and being able to operate at different varying speeds; however, they have not been effective to solve all the problems mentioned above and are particularly ineffective in extremely deep well application due to the excessive weight of the pump rod strings in such deep well application.

SUMMARY OF THE INVENTION

Accordingly, it is an object of the present invention to provide a novel and versatile hydraulically operated surface pumping unit for oil wells.

It is also an object of the present invention to provide a counterbalanced cross beam type surface pumping unit that does not have gear boxes, belts, chains or pulleys.

Another object of the present invention is to provide a cross beam type surface pumping unit that can be fully counterbalanced for smooth operation and minimum energy consumption.

A further object of the present invention is to provide a hydraulically operated surface pumping unit in which length and speed of strokes can be adjusted easily and over broad ranges.

Still another object of the present invention is to provide a surface pumping unit for oil wells that can be operated with a slower upstroke and faster down stroke.

A still further object of the present invention is to provide a surface pumping unit for oil wells which accomodates a very slow letdown stroke for down hole tag out of the piston in the pump cylinder while setting proper space out and to prevent hammering in the down hole pump cylinder during initial set-up and counterbalancing operations.

Another object of the present invention is to provide a hydraulic operated surface pumping unit for oil wells that is designed and equipped to operate in extreme climatic conditions of hot or cold weather with low maintenance requirements.

The hydraulically operated surface pumping unit of the present invention includes a double acting hydraulic cylinder connected pivotally to a horizontal cross beam apparatus. The cross beam is pivotally mounted on a frame structure in such a manner that its ends can oscillate up and down in a vertical plane. One end of the cross beam is adapted to attach to the pump rod of a down hole cylindrical or barrel type pump, and a double acting hydraulic cylinder is attached to the cross beam to move the cross beam in oscillating upstroke and down stroke cycles. The invention also includes novel pilot operated valve apparatus for directing hydraulic fluid under pressure to appropriate ends of the hydraulic cylinder to produce upstrokes and down strokes for driving the cross beam in oscillating cycles. The valve apparatus also includes optional settings for effecting either a first mode where the upstroke speed equals the down stroke speed or a second mode where the upstroke speed is slower than the down stroke speed. The valve apparatus also includes intermediate positions to maintain more constant pressure on the hydraulic cylinder and to lock the hydraulic cylinder against movement in either direction from external forces during phase shifts from upstroke to down stroke and visa versa.

The valve apparatus is pilot operated by application of hydraulic fluid pressure to actuator cylinders on opposite ends of the valve spool, and corresponding bleed off valves are provided for each actuator cylinder to bleed off pressure and to restore pressure at programed positions in the upstroke and down stroke cycle. The bleed off valves are cam actuated by cams attached to and adapted to move in unison with the oscillating motion of the cross beam. The cams can be adjusted to provide long or short upstroke and down stroke cycles as desired by the operator.

Hydraulic fluid under pressure is supplied by an oil pump, the output rate of which can be varied by an operator to effect slower or faster cycling speeds of the oscillating upstrokes and down strokes. A needle valve flow control is also provided in the main return line to tank to effect a very slow down stroke speed for down hole tag out and to avoid hammering the down hole pump cylinder during initial set-up, space out setting, and counterbalancing operations. Hydraulic pressure meters are provided in both flow lines to opposite ends of the hydraulic cylinder to accomodate obtaining optimum counterbalance adjustment for minimum energy consumption and maximum smooth and continuous operation. A shock absorbing accumulator in the hydraulic system and shock absorber cylinder mountings reduce potentially damaging shock forces that result from elastic stretch and snap back of the pump rods in direction reversal during upstroke and down stroke phase changes in the oscillating cycles.

The invention also includes a combination oil tank or reservoir and oil cooling unit with a safety overflow feature to prevent starving the hydraulic pump and operating system of hydraulic fluid, particularly during start-up in extreme cold weather conditions when the hydraulic fluid is too cold and viscous to flow readily through the cooling tubes or in the event the cooling tubes should become plugged.

BRIEF DESCRIPTION OF THE DRAWINGS

Other objects, advantages and capabilities of the present invention will become more apparent as the description of the preferred embodiment is continued as considered in conjunction with the drawings in which.

DESCRIPTION OF THE PREFERRED EMBODIMENT

Figure 1:
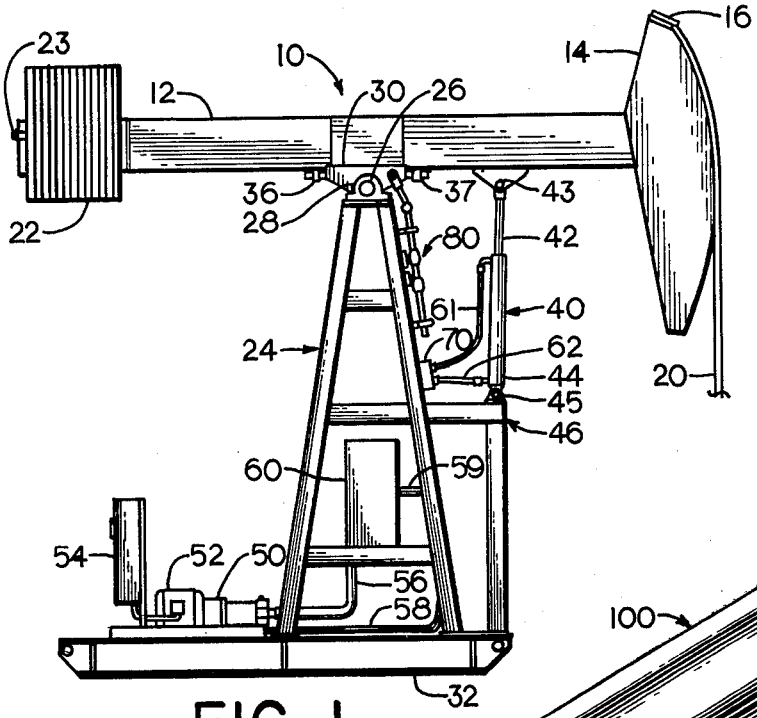
FIG. 1 is a side elevational view of the surface pumping unit of the present invention.

The hydraulically driven surface pumping unit 10 of the present invention is shown in FIG. 1. Its configuration of a counterbalance cross beam 12 pivotally attached to the top of a main support frame 24 with a cable mount and guide plate 14 on one end and a counter weight 22 on the opposite end is similar to a conventional gear driven surface pumping unit. The cross beam 12 is positioned in a support block 30. A main shaft 26 is attached transversly to the support block 30 and is journaled in bearings 28, which are attached to the top of the main frame 24. When mounted in this manner, the cross beam 12 can rock up and down in a vertical plane about the axis of main shaft 26. A lift cable 20 is attached at its upper end to a cable anchor 16 on the cable mount and guide plate 14 and extends downwardly for attachment to the upper end of a conventional well pump rod (not shown). The counterweights 22 are mounted on the opposite end of the cross beam 12 in the conventional manner to balance the weight of the pump rod (not shown) pulling downwardly on the cable 20. The counterweights 22 are mounted on adjusting bolt 23 so they can be moved inwardly and outwardly to adjust the counterbalance. The alignment screws 36, 37 on opposite ends of the support block 30 are provided to set and maintain the alignment of the cross beam 12 and provide some additional adjustment of the respective lengths of the lever arms of cross beam 12 on opposite sides of the main shaft 26 for adjusting counterbalancing. The main frame 24 is mounted on a skid base 32.

The above description of the main structure of the surface pumping unit is common to conventional gear driven surface pumping units and is provided for background information only. The apparatus and method for driving and controlling the surface pumping unit described below, however, constitutes the claimed invention.

The hydraulic drive includes a hydraulic cylinder 40, a hydraulic pump 50 driven by an electric motor 52, a main control valve 70 and phase control apparatus 80. The claimed invention also includes the oil tank and cooler unit 60. Each of these components with its respective functions will be described in more detail below. Broadly, however, the hydraulic cylinder 40 is attached to the cross beam 12 to drive the cross beam 12 upwardly and downwardly in a rocking arcuate motion about the axis if main shaft 26, which motion imparts a reciprocal vertical movement to the cable.

A cylinder support structure 46 extends laterally outwardly from main frame 24 and upwardly from skid base 32. The blind end 44 of the hydraulic cylinder 40 is pivotally attached at 45 to the support structure 46. The rod end 42 of the cylinder 40 is pivotally attached at 43 to the cross beam 12 a spaced distance outwardly from the main shaft 26.

The motor 52 can be electric, such as that shown in FIG. 1, or any other suitably powered motor or engine. The motor 52 is attached to the hydraulic pump 50 for providing hydraulic under pressure to the hydraulic cylinder 40 and to the rest of the hydraulic operating system. The main valve 70 controls the hydraulic fluid directed into and out of opposite ends of the hydraulic cylinder 40. The phase programing apparatus 80 programs and controls the functions of main valve 70 to effect the desired characteristics of the up and down stroke movement of the cross beam 12. The oil cooler 60 serves the dual functions of a reservoir or tanks for storing hydraulic fluid and to cool the hydraulic fluid during operation of the pumping unit. The electric switch box 54 is shown as the power connection source for electric motor 52.

Figure 3:
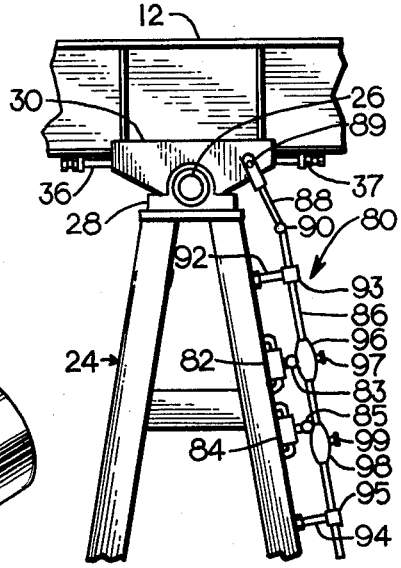
FIG. 3 is an enlarged elevation view of the cam operated phase program control apparatus of the present invention.
Figure 2:
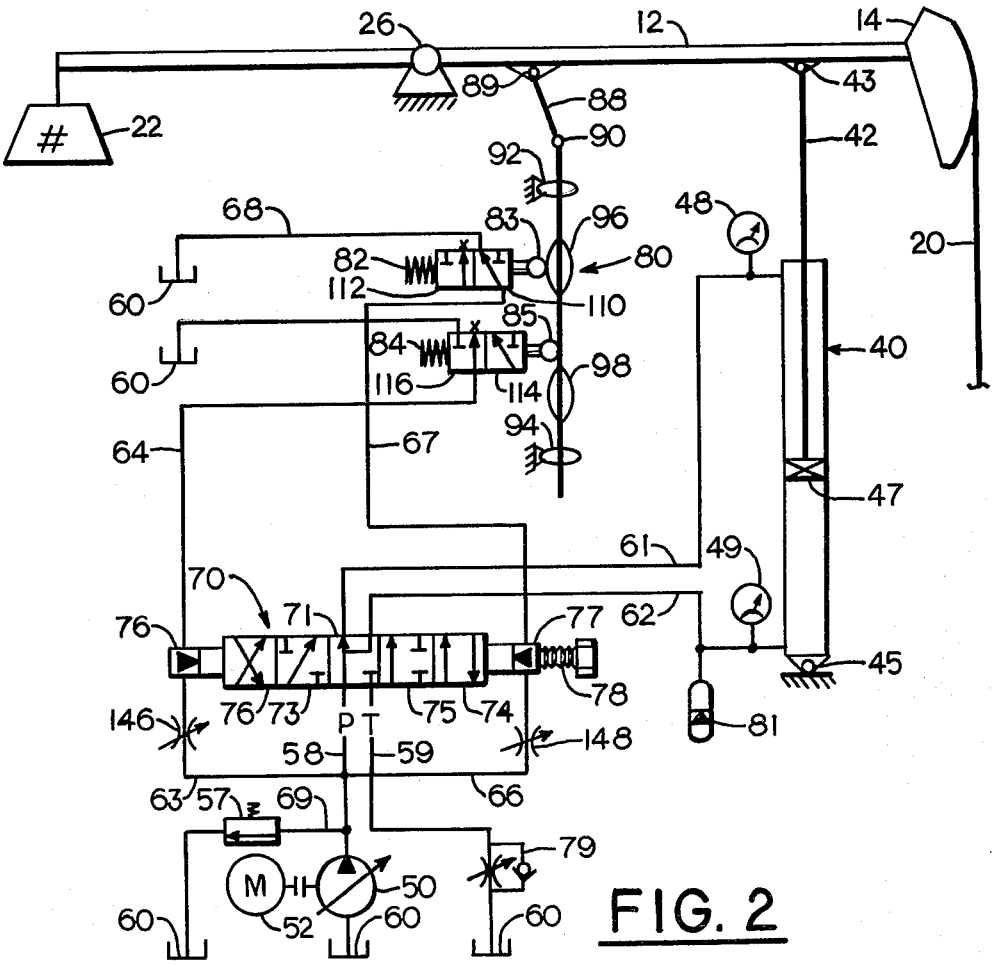
FIG. 2 is a schematic diagram of the hydraulic control system of the present invention.

For a detailed description of the unique hydraulic circuit and phase control apparatus of this invention, reference is made to the schematic diagram in FIG. 2 and to the enlarged elevation of the phase program control apparatus 80 in FIG. 3. As is shown in FIG. 2, the cross beam 12 is shown as an elongated lever pivotal in a vertical plane about a fulcrum defined by the main shaft 26. The cable mount and guide plate 14 is mounted on one end of the cross beam 12 with the pump rod lift cable 20 depending downwardly therefrom. The counter weight 22 is mounted on the opposite end of the cross beam 12 to counterbalance the weight of the pump rod string (not shown) suspended from the cable 20.

The hydraulic cylinder 40 is a double acting cylinder with a piston 47 positioned to slide upwardly and downwardly therein in response to hydraulic fluid pressure applied on either side thereof. A rod 42 extends upwardly from the piston 47 and is attached to the cross beam 12 at 43, as described above. A first hydraulic fluid flow line 61 is connected to the rod end of the cylinder, and a second hydraulic fluid flow line 62 is connected to the blind end of the cylinder 40.

In the application of this invention, the cross-sectional area of the rod 42 is preferably one-half the surface area of the piston 47. The advantage of this rod to piston side ratio will become apparent from the description below.

An adjustable rate hydraulic pump 50 driven by motor 52 is provided to draw hydraulic fluid from the reservoir or tank 60 and pump it under pressure through main pressure line 58 into the operating system. A main control valve 70 connected to the main pressure line 58 and to the hydraulic flow lines 61, 62 is uniquely designed to direct hydraulic fluid to appropriate flow lines or interrupt the flow of hydraulic fluid as appropriate for the various operating phases to be described below. The main control valve 70 is pilot operated by hydraulic fluid pressure as controlled by the bleed valves 82, 84, both of which are components of the phase program control apparatus 80.

A significant feature of this invention is the configuration and function of the main control valve 70. It is provided with a reciprocating spool having five flow control positions 71, 72, 73, 74 and 75. The center position 71 is uniquely configured to direct hydraulic fluid under pressure from main pressure line 58 into both flow lines 61, 62 concurrently. Therefore, in this center position 71, equal fluid pressure is applied to the rod end and the blind end of the cylinder 40 at the same time. There is no connection to the tank in this mode center position 71 for return flow to tank 60.

The extreme right position 74 is a straight flow through configuration to direct hydraulic fluid under pressure from main pressure line 58 into flow line 61. Return flow from the hydraulic cylinder 40 through flow line 62 is directed back to tank 60 via return line 59. Therefore, in this extreme right position 74, hydraulic fluid under pressure is directed from the pump 50 to the rod end of the cylinder 40, and return flow from the blind end of the cylinder 40 is returned to tank 60.

The extreme left position 72 is a cross-over configuration which directs hydraulic fluid under pressure from the main pressure line 58 to flow line 62. It also directs return flow from line 61 into return line 59 for flow back to tank 60. Therefore, in this position 72, the hydraulic fluid under pressure from pump 50 is directed to the blind end of cylinder 40, and return flow from the rod end of cylinder 40 is returned to tank 60.

The intermediate right mode 75 and intermediate left mode 73 are transient modes provided to prohibit any movement of the rod 42 as the spool of main valve 70 shifts from one main position 71, 74, or 72 to another main position. The internal plumbing of hydraulic control valves are such that hydraulic fluid can bypass the spool through port ducts in the valve body and flow to tank when the spool of the valve is between defined flow control positions. Such leakage in the valve body could allow the hydraulic cylinder to collapse under the weight forces on the cross beam 12 as the valve spool is between defined positions. Such a flaw in the system can result in undesirable jerking of the machinery during phase shifting between up and down strokes, and it could present a safety hazard if the pumping unit is shut down when the main valve 70 is between main operating positions. However, such undesirable consequences are prevented by providing the intermediate lock positions 73, 75 shown in the main valve 70 of this invention.

In the valve 70 configuration shown in FIG. 2, the intermediate right position 75 has a straight flow through post to direct hydraulic fluid under pressure from main pressure line 58 to flow line 61 corresponding to the similar port in extreme right mode 74. This connection provides continuity in pressure application to the piston 47 to smooth phase shift transition. However, return flow through line 62 is blocked by position 75, thereby prohibiting collapse of the hydraulic cylinder 40 due to external forces on rod 42. Similarly, the intermediate left mode 73 includes a cross over port similar to the cross over port in extreme left position 72 to direct hydraulic fluid under pressure from main pressure line 58 to flow line 62. However, return flow through line 61 is blocked by intermediate left position 73 to prevent collapse of cylinder 40.

There are two principal operating modes of the hydraulic drive of this invention. In the first operating mode, the upstroke of rod 42 is equal in speed to the down stroke. Therefore, the cross beam 12 and the pump rod lift cable 20 of the surface pumping unit 10 are driven upwardly and downwardly at equal rates of speed.

In the second mode, the upstroke of the rod 42 is at a slower speed than the down stroke. Therefore, the upward movement of the cross beam 12 and pump rod lift cable 20 in the second operating mode is slower than the downward movement. In the structure described herein, the cross-sectional area of the rod 42 is preferably equal to one-half the surface area of the piston 47, the upstroke is one-half the speed of the down stroke. Of course, this ratio could be varied by varying the ratio of the cross-sectional area of the rod 42 to the surface area of the piston 47; however, the prefered 1:2 ratio described above will be used for the purposes of this description.

The operation of the first mode described above with equal speeds on both the upstroke and the down stroke is accomplished by continuous alternating use of the center or middle valve position 71 and the extreme right valve position 74. Operation in the second mode wherein the upstroke is at one-half the speed of the down stroke is accomplished by continuous alternating use of the extreme left position 72 and the extreme right position 74.

In the first operating mode, where it is desired that the upstroke speed equal the down stroke speed, the straight flow through configuration of the extreme right position 74 is used to effect a down stroke of rod 42. In this extreme right position 74, hydraulic fluid under pressure from main pressure line 58 is directed straight through the valve 70 into flow line 61 to the rod end of hydraulic cylinder 40. Therefore, the pressure on the rod end of the hydraulic cylinder 40 causes the piston 47 to move downwardly in a down stroke. At the same time, return hydraulic fluid forced out of the blind end of the hydraulic cylinder 40 through flow line 62 is directed by extreme right position 74 straight through the valve 70 and into the return line 59 for flow to tank 60.

For the upstroke of the first operating mode, the main valve 70 is aligned in middle position 71. In this middle position 71, hydraulic pressure from main pressure line 58 is directed to both flow lines 61, 62. Therefore, in this position 71, the pressure in both the rod end and in the blind end of the cylinder 40 are equal. However, since the surface area of the blind side of the piston 47 is twice the surface area of the rod side of the piston 47, the total up force exceeds the total down force and the piston 47 is driven upwardly. As the piston 47 moves upwardly in this upstroke phase, the hydraulic fluid in the rod end of the cylinder 40 is forced out through flow line 61 against the pressure of the pump. However, since such return flow cannot be forced back into the pump, it is added to the hydraulic fluid flow directed into flow line 62 to the blind end of cylinder 40. Therefore, even though the pressure on both sides of the piston 47 is equal, the flow rate of hydraulic fluid into the blind end of hydraulic cylinder 40 is twice the flow rate output of the pump 50. However, since the volume to be filled on the blind end of the cylinder 40 on the upstroke is twice the volume of the rod end of the cylinder 40 that must be filled on a down stroke, the upstroke speed resulting from the middle valve position 71 is equal to the down stroke speed resulting from the extreme right valve position 74. Consequently, in this first operating mode where the main valve 70 alternates between middle position 71 and extreme right position 74, the speed of the upstroke equals the speed of the down stroke.

Operation in the second mode wherein the upstroke is at one-half the speed of the down stroke requires alternating movement of the spool of valve 70 between the extreme right position 74 and the extreme left position 72. As already described above for the first operating mode, in the extreme right position 74, hydraulic fluid under pressure is directed from main pressure line 58 into flow line 61 to the rod end of cylinder 40, which causes a down stroke. At the same time, return fluid flow forced out of the blind end of cylinder 40 during down stroke is returned through line 62 and straight through the extreme right position 74 into return line 59 to flow to tank 60. That down stroke phase of the first mode of operation by use of position 74 is the same as the down stroke phase of the second mode of operation.

For the upstroke, however, the valve 70 is moved to the extreme left position 72. In the cross over configuration of the extreme left position 72, hydraulic fluid under pressure is directed from main pressure line 58 into flow line 62 to the blind end of cylinder 40. At the same time, return flow from the rod end of the cylinder 40 flows through line 61 and is crossed over in valve position 72 into return line 59 to flow to tank 60. In this position 72 therefore only the pressure flow from pump 50 to the blind end of cylinder 40 acts on the piston 47 to drive the rod 42 in an upstroke. Since the volume to be filled with fluid in the blind end of cylinder 40 on the upstroke is twice as large as the volume of the rod end of the cylinder 40 to be filled on the down stroke, the constant flow rate from the hydraulic pump 50 takes twice as long to push rod 42 in an upstroke as to push rod 42 in a down stroke. Therefore, the upstroke resulting from position 72 is at half the speed of the down stroke resulting from position 74.

As mentioned above, the main control valve 70 is pilot actuated to shift from one position to another in response to fluid pressure applied selectively to pilot actuating cylinders on the ends of the spool of main valve 70. A first pilot actuating cylinder 76 is positioned on the left end of the spool of main valve 70, and a second pilot actuating cylinder 77 is positioned on the right end of the spool. When hydraulic pressure is applied to pilot actuator 76, it shifts the spool toward the right thereby aligning the extreme left position 72 with the valve ports. Likewise, when the right pilot actuator cylinder 77 is pressurized with hydraulic fluid, the pilot actuator 77 shifts the spool to the left thereby aligning the extreme right position 74 with the valve ports. Therefore, by alternately pressurizing pilot actuator 76 and pilot actuator 77, the main valve 70 is shifted first to the extreme right position 74 then to the extreme left position 72 and the cycle continues. This alternating position cycle of course results in the alternating up and down strokes of the hydraulic cylinder 40 in the second mode as described above.

The mode adjustment screw 78 positioned at the right end of the main valve 70 is used to set the main valve 70 to operate either in the first mode of equal speed up and down strokes or to operate in the second mode of slow up and fast down strokes. This adjuster screw 78 can be screwed into the valve body to physically block the rightward motion of the spool. Therefore, appropriate adjustment of the screw 78 allows a hydraulic pressure in pilot actuator cylinder 76 to move the spool only to the middle position 71 for the upstroke of the first mode. Of course, an alternate pressure in pilot actuator cylinder 77 causes the spool to shift to the left to align the extreme right position 74 with the valve ports to effect the down stroke of the first mode. Of course, when equal pressure is applied to both the left and right pilot actuators 76, 77 at the same time, the net result is that the spool of the main control valve 70 will remain motionless in whichever position happens to be aligned with the valve ports at the time the equal pressure is applied. The same result would apply of course if no pressure is applied to either pilot actuators 76, 77 at the same time.

The application of hydraulic fluid pressure alternately to the left and right pilot actuator cylinders 76, 77 is controlled by the phase program control apparatus 80, which includes two cam actuated bleed off valves 82, 84. Hydraulic fluid under pressure is supplied to the left pilot actuator 76 by a branch pressure line 63 tapped into the main pressure line 58. A return line 64 conducts hydraulic fluid exhausted from the pilot actuator 76 through the lower bleed off valve 84 and via return line 65 to tank 60. Therefore, when the bleed off valve 84 is opened to allow hydraulic fluid to flow therethrough, the effect is that the branch pressure line 63 and pilot actuator 76 are open to tank so that there is no effective pressure buildup in the pilot actuator 76, and it is incapable of moving the spool in main valve 70 to a different position or to resist movement of the spool toward the left. However, when the bleed off valve 84 is closed so that hydraulic fluid is blocked from flowing therethrough, the hydraulic fluid flow from branch pressure line 63 pressurizes the pilot actuator 76 to apply a rightwardly directed shifting force to the spool of main valve 70. Therefore, alternately shifting bleed off valve 84 from a flow through position 114 to a blocked position 116 results in alternative pressure build up and pressure bleed in the pilot actuator 76.

In a like manner, hydraulic fluid under pressure is supplied to the right pilot actuator 77 to branch pressure line 66 tapped into main pressure line 58. Actuator drain line 67 conducts exhausted hydraulic fluid from the pilot actuator 77 through bleed off valve 82 and via return line 68 back to tank 60. Therefore, when bleed off valve 82 is in an open position 110 to allow flow of hydraulic fluid therethrough, the pilot actuator 77 is effectively open to tank and there is insufficient effective pressure therein to apply the shifting force to the spool of main valve 70 or to resist shifting of the spool to the right. Alternately, when bleed off valve 82 is shifted to a closed position 112 wherein flow of hydraulic flow therethrough is blocked, hydraulic fluid pressure is built up in pilot actuator 77 to apply a leftward directed shifting force to the spool of main valve 70.

The bleed off valves 82, 84 are spring biased to the closed position 112, 116, respectively. In this position, the straight flow through ports of positions 112, 116, respectively, are plugged so that fluid cannot flow therethrough. Alternately, the cross over configuration of positions 110, 114 of bleed off valve 82, 84, respectively, are configured to connect the respective drain lines 67, 64 to the return lines 68, 65. The bleed off valves 82, 84 are cam actuated to shift against the spring bias from the closed to open positions.

As shown in FIGS. 2 and 3, the cam actuator mechanism of the phase program control apparatus 80 includes an elongated rod 86 with upper and lower cams 96, 98, respectively, mounted thereon. The elongated rod 86 is movable longitudinally in a reciprocating motion upwardly and downwardly. The sleeves 93, 95 of supports 92, 94, both of which are mounted on the lateral side of main frome 24 support the cam rod 86 a spaced distance from bleed valves 82, 84. A link rod 88 and connector 89 pivotally connect the elongated cam rod 86 to the cross beam 12 in such a manner that the oscillating across beam 12 causes reciprocating vertical movement of cam rod 86. In order to accomodate the angular movement of the cross beam 12 in relation to the reciprocating cam rod 86, link rod 88 is connected to cam rod 86 by pivotal connector 90. Therefore, a down stroke of the hydraulic cylinder 40 and cross beam 12 causes a corresponding down stroke of the cam rod 86, and and upstroke of the cam rod 86.

Bleed off valve 82 has a roller type cam follower 83 adapted to contact upper cam 96, and bleed off valve 84 has a roller type cam follower 85 adapted to contact lower cam 98. As cam follower 83 contacts upper cam 96, the bleed off valve 82 is shifted to the flow through position 110. Movement of cam 96 away from cam follower 93 of course allows the bleed off valve 82 to shift back to the closed or blocked position. Likewise, as lower cam 98 moves into contact with cam follower 85, bleed off vlave 84 is caused to shift to the flow through position 114. As cam 98 moves away from cam follower 85, the bleed off valve 84 is allowed to shift back to the closed or blocked position 116. In this manner, the upper cam 98 defines the extremity of the upstroke movement, and the lower cam 96 defines the lower extremity of the down stroke movement.

As shown in FIG. 3, the upper cam 96 is adjustable upwardly and downwardly on cam rod 86 by loosening and tightening a set screw 97 in cam 96. Likewise, lower cam 98 is adjustable positioned on cam rod 86 and can be set by loosening or tightening set screw 99 in cam 98. The adjustable settings of the upper and lower cams 96, 98 as just described accomodates setting the surface pumping unit for long strokes or short strokes as desired by the operator. The distance between upper and lower cams 96, 98 is directly correlated to the distance of the upstrokes and down strokes.

It should be noted that an adjustable restrictor 146 is preferably provided in branch pressure line 63, and a similar adjustable restrictor 148 is preferably provided in branch pressure line 66 upstream of the respective pilot actuators 76, 77. Such restrictions in the branch pressure lines 63, 66 limit the volume of hydraulic fluid under pressure allowed to flow into the pilot actuator 76, 77 so that when the respective bleed off valves 82, 84 are open, the resulting pressure bleed off is more immediate and the valve actuators are more responsive. The adjustable features of the respective restricters 146, 148 allow an operator to fine tune the responsiveness of the actuators 76, 77 of the main control valve 70.

In operation in the first mode wherein the upstroke and down stroke are of equal speeds, pressurized hydraulic fluid from main pressure line 58 might be initially directed through main valve position 74 into flow line 61 to the rod end of cylinder 40. The pressure in the rod end cylinder 40, of course, forces the piston 47 down to effect a downstroke of the rod 42. In this position, hydraulid fluid from the blind end of cylinder 40 is drained through flow line 62 and straight through position 74 to return to tank via return line 59. During this down stroke, cam 96 is moved toward contact with cam follower 83 of bleed off valve 82. When this contact is made, bleed off valve 82 is shifted to the open position 110, as shown in FIG. 2, to bleed off the hydraulic fluid pressure in right pilot actuator 77. This bleed off of pressure in pilot actuator 77 while pressure is maintained in left pilot actuator 76, allows the left pilot actuator 76 to push the main valve spool rightwardly.

With the adjuster screw 78 properly adjusted for the first operating mode, the spool will shift through position 74 where movement of rod 42 is prohibited and into middle position 71. Further rightward movement of the spool is blocked by adjuster screw 78 so that middle position 71 is aligned with the valve port. In this position the hydraulic fluid under pressure from main pressure line 58 is directed to both flow lines 61, 62. However, as described above, the differential in effective areas on opposite sides of piston 47 under equal pressure conditions on both sides of the piston cause an imbalance in total force resulting in piston 47 moving up in an upstroke. Also as described above, the fluid exhausted from the rod end of cylinder 40 is circulated through line 61 and back into the blind end of the cylinder along with fluid from the pump 50 via line 62 to cause the upstroke speed to equal the down stroke speed.

During this upstroke, the cams 96, 98 are also moved upwardly. Of course, almost as soon as the upward motion of cam 96 is begun, cam 96 moves away from cam follower 83 and bleed off valve 82 is allowed to shift back to the closed position 112, thereby effecting a pressure buildup in pilot actuator 77 to equal the pressure in pilot actuator 76. Since the pilot actuator 76, 77 are of equal size, when they are under equal pressure conditions such as this, the main valve 70 is locked in the middle position 71 to continue the upstroke motion.

As the upstroke motion continues, the cam rod 86 also continues upwardly until eventually cam 98 contacts cam follower 85. When this contact is made, bleed off valve 84 is shifted to the flow through position 114 resulting in a drop of pressure in pilot actuator 76. As soon as the pressure drops in pilot actuator 76, the hydraulic fluid pressure in pilot actuator 77 causes the spool of main valve 70 to shift back again to the extreme right position 74. Of course in the position 74, a down stroke is started again, which also causes the cam rod 86 to start downwardly. As cam rod 86 starts downwardly, cam 98 moves away from contact with cam follower 85 and bleed off valve 84 is again allowed to return to the closed or blocked position 116, thereby allowing a pressure buildup in pilot actuator 76 to balance the pressure in pilot actuator 77 and to lock the main control valve 70 in the straight flow through position 74 for the continuation of the down stroke. The cycle of upstrokes and down strokes at equal speeds continues in this manner as long as the pump 50 supplies a constant flow of hydraulic fluid under pressure to the system.

The operation of the apparatus in the second mode of fast downstroke speed and slow upstroke speed is essentially the same as that described for the first mode except that the adjuster screw 78 is backed off to allow the spool of main valve 70 to shift all the way from the extreme right position 74 to the extreme left position 72.

One of the advantages of the hydraulic driven surface pumping unit of this invention is that the system can be balanced to minimize the power input requirement for operating the oil well pump. Oil pressure guages 48, 49 are provided in flow lines 61, 62, respectively to accomodate reaching such an optimum balance. An optimum balance is achieved when the pressure on the upstroke in flow line 62 is approximately equal to the pressure of the down stroke in flow line 61. Such an optimum balance can be achieved by the amount of weight 22 mounted on the distal end of cross beam 12 and adjusting the lever arm distance of that weight from the fulcrum or main shaft 26. The amount of the weight 22 and adjustment of the lever arm distance of course will depend on the weight of the pump rod suspended on lift cable 20. Such counterbalancing is also the goal in conventional gear driven surface pumping units. It is almost essential to install a rod dynamometer on conventional units to even get close to a proper counterbalance, but an optimum balance under such circumstances is difficult if not impossible to achieve. However, in the present invention, with the advantageous use of the hydraulic fluid pressure guages 48, 49, such an optimum or near optimum counterbalance configuration can be achieved quite easily without the use of a rod dynamometer.

Another feature provided in the system of this invention is a needle valve flow control 79. This needle valve 79 is adjustable and advantageously serves a valuable function during initial set-up and adjustment of the surface pumping unit 10. Since it is virtually impossible to set up the system with the proper counterbalance on the initial setting, it is not unusual for the weight of the pump rod to fall almost uncontrolled on the down stroke due to insufficient weight 22 on the counter balance. By adjusting the needle valve 79 to allow only a very slow return flow of hydraulic fluid to tank 60, a back pressure is held in the blind end of cylinder 40 on the down stroke to control the speed of the down stroke until the counterbalancing can be adjusted into proper proportions. This back pressure control feature on the down stroke during counterbalancing minimizes or eliminates hammering of the piston on the bottom end of the cylinder in the down hole well pump during the counterbalancing adjustment of the surface pumping unit and reduces or minimizes chances of damage to the equipment during such initial set-up and adjustment operations.

In deep wells the weight of the pump rod string is extremely heavy, and in such lengths, the pump rod tends to stretch and snap back upon reversal in direction of vertical movement. The shock that results from such stretching and snapping of the pump rod can be distructive to the mechanism of the surface pump unit. Therefore, to minimize the effect of such shock, the cylinder 40 can be mounted with shock absorber mounting pins 100 such as that shown in FIG. 4. The shock absorber mounting pin 100 includes a metal inner sleeve 103 positioned concentrically inside a larger metal outer sleeve 101. The annular space between the outer sleeve 101 and the inner sleeve 103 is filled with a live rubber shock absorber material 102, which is bonded to the inner surface of sleeve 101 and the outer surface of sleeve 103. This shock absorber mounting pin 100 is positioned in the cross beam 12 at the point of attachment of the cylinder, and the cylinder mounting pin 43 is adapted to pass through the cylinder, and the cylinder mounting pin 43 is adapted to pass through the interior 104 of inner sleeve 103. A similar shock absorber mounting sleeve 100 can be used at the lower pivotal mounting 45 of the cylinder 40 to the support structure 46.

An accumulator 81 is also provided in flow line 62 to provide a shock absorber function as the main valve 70 is switched from upstroke to down stroke positions. A pressure release valve 57 is provided a branch return line 69 tapped into the main pressure line 58 for safety or overload conditions.

Figure 4:
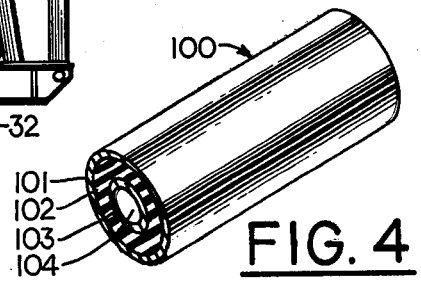
FIG. 4 is a perspective view of a shock absorber mounting pin for the hydraulic cylinder.
Figure 5:
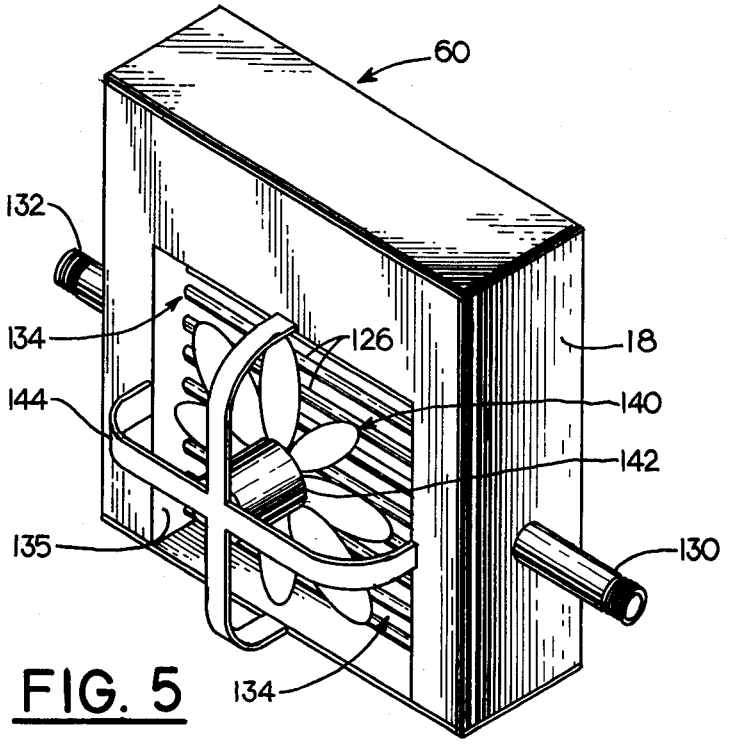
FIG. 5 is a perspective view of the combination hydraulic fluid reservoir and cooling unit.
Figure 6:
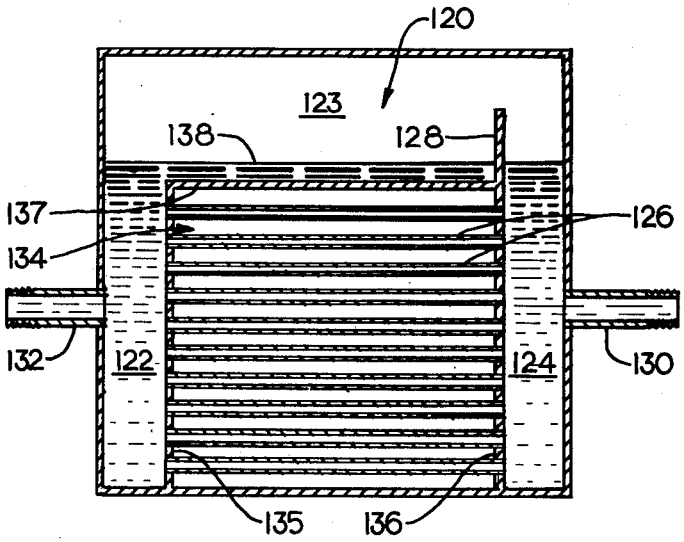
FIG. 6 is a cross-sectional view in elevation of the combination fluid storage reservoir and cooling unit of the present invention.

Another feature of the hydraulic operated surface pumping unit 10 of the present invention is the combination oil tank and cooler unit 60 shown on FIGS. 4 and 5. The reservoir includes an exterior shell 118 with an interior chamber 120 therein. The chamber 120 is comprised of a left side reservoir portion 122 and a right side reservoir portion 124 connected with a common top portion 123. A boxed out opening 134 separates the left side reservoir portion 122 from the right side reservoir portion 124. Left and right sidewalls 135, 136 and top wall 137 define the boxed out opening 134. A plurality of cooling pipes 126 extend from the left side 135 to the right side 136 through which the left reservoir portion 122 and the right reservoir portion 124 are connected in fluid flow relationship. The right sidewall 136 extends upwardly beyond the top wall 137 a substantial distance into the common top portion 123 of the reservoir 120 as shown at 128. An inlet pipe 130 conducts fluid into reservoir portion 124, and an outlet pipe conducts fluid out of reservoir portion 122 for flow to the pump 50.

A fan 140 is mounted on and driven by a motor 142 in the boxed out opening 134 adjacent the cooling tubes 126. The motor 142 and fan 140 are mounted in the boxed out opening 134 by appropriate mounting brackets 144. As shown in FIG. 5, the reservoir 120 is preferably filled with hydraulic fluid up to a level that flows over the boxed out opening 134 but below the upper extension 128 of right sidewall 136.

In normal operation, oil is drawn by the hydraulic pump from the left side of the reservoir 122 through outlet pipe 132, and the hydraulic fluid is returned from the system to the reservoir 60 by flowing through inlet pipe 130 into the right side portion 124 of the reservoir 120. As such flow continues, the hydraulic fluid is drawn from the right portion 124 through the cooling tubes 126 to the left reservoir portion 122 prior to being pumped into the working hydraulic system. As the hydraulic fluid flows through the tubes 126, the fan 140 blows air over the exterior of the tubes 126 for a heat exchanger function wherein the heat from the oil is transferred to the air in a conventional manner for cooling.

A novel feature of the combination oil tank and cooling unit 60 of this invention is the combination divider and safety overflow feature provided by the extension 128 of right sidewall 136. Under normal operation as described above where the pressure gradient is small or insignificant between the left and right portions 122, 124 of the reservoir 120, the fluid level in the reservoir top reservoir portion 123 remains below the upper extremity of the extension 128. However, if the hydraulic fluid is extremely stiff, as under start-up conditions in geographical areas where the atmosphere in the winter is extremely cold, the hydraulic fluid will be extremely viscous, and it might not flow readily through the cooling tubes 126. Under such conditions, it is imparitive for the longevity of the hydraulic system pumping and control conponents that the oil continue to flow through the outlet 132 to the pump 50. Such flow will create a pressure gradient between left portion 122 and right portion 124 of the reservoir 120. Incoming hydraulic fluid in reservoir portion 124 under such conditions may build up to the point where it flows over the top of extension 128 of right sidewall 136. In this manner, even when the oil is stiff and the cooling tubes become plugged hydraulic fluid will continue to circulate through the pump and working system.

Although the present invention has been described with a certain degree of particularity for illustrative purposes, changes in detail of structure can be made without departing from the scope hereof.

What is claimed is:

1. In apparatus for producing reciprocal mechanical motion for lifting and lowering a well pump rod string, the improvement comprising:

a double acting hydraulic cylinder and valve means adapted to direct hydraulic fluid under pressure to the rod end of said cylinder while allowing hydraulic fluid to drain from the blind end of the cylinder to tank to produce a phase of the reciprocal motion in one direction, and then alternatively in cycle to direct hydraulic fluid pressure to both the rod end and the blind end of said cylinder simultaneously through a fluid connection common to both said rod and blind ends while prohibiting fluid from either said rod and blind ends of the cylinder to escape to tank to produce a phase of the reciprocal motion in the opposite direction said valve means also including an intermediate position adapted to direct hydraulic fluid pressure to one end of said cylinder while prohibiting escape of hydraulic fluid from the other end of the cylinder as said valve means is in transition during cycling between said phases of reciprocal motion.

2. The improvement of claim 1, wherein said intermediate position of said valve means is adapted to direct hydraulic fluid pressure to the rod end of said cylinder and to block escape of hydraulic fluid from the blind end of said cylinder.

3. A hydraulically operated surface pumping unit comprised of:

pump rod lift means adapted to attach to and pull upwardly on a well pump rod;

hydraulic motion producing means connected to said pump rod lift means for moving said pump rod lift means upwardly and downwardly, said motion producing means being reversible by reversing the flow direction of the hydraulic fluid thereto; and a valve having a position of straight flow through configuration and a position of cross over configuration for alternately directing hydraulic fluid under pressure in one direction to drive said pump rod lift means upwardly and in the opposite direction to drive said pump rod lift means downwardly, said valve including a safety lock position intermediate of said straight flow through and said cross over positions with a configuration adapted to direct hydraulic fluid under pressure to said motion producing means in one direction while prohibiting fluid flow from said motion producing means during shifting of the valve between the straight flow through and cross over positions.

4. The surface pumping unit of claim 3, wherein said hydraulic motion producing means includes a double-acting hydraulic cylinder with a first hydraulic fluid flow line connected to the rod end thereof and a second hydraulic flow line connected to the fluid end thereof, said valve means includes a valve having a position of straight flow through configuration and a position of cross over configuration, whereby hydraulic fluid under pressure can be directed alternately to the rod end of said hydraulic cylinder and to the blind end thereof, and said safety lock means includes a position in said valve intermediate of said straight flow through and said cross over positions with a configuration adapted to direct hydraulic fluid under pressure to one end of said cylinder while prohibiting fluid flow out of the opposite side of the cylinder.

5. The surface pumping unit of claim 4, wherein said valve includes a position having a common flow line connecting configuration adapted to direct hydraulic fluid under pressure to both the rod end and the blind end of the hydraulic cylinder simultaneously as it prohibits any return flow from either end of cylinder to tank.

6. The surface pumping unit of claim 5, wherein said valve can be selectively set in a first mode to alternate phases back and forth between said straight flow through configuration and said common flow line connecting configuration, and said valve can also be selectively set in a second mode to alternate phases back and forth between said straight flow through configuration and said cross over configuration.

7. The surface pumping unit of claims 4 or 6, wherein said valve is pilot actuated to switch from one position to another by hydraulic fluid pressure applied selectively to actuators on opposite sides thereof, each of said actuators having hydraulic pressure applied thereto and each of said actuators having pressure bleed means associated therewith for bleeding hydraulic fluid pressure from said respective actuators, and said bleed means being activated by phase programming means sensitive to the physical position of said pump rod lift means.

8. The surface pumping unit of claim 7, wherein said pressure bleed means includes a bleed valve adapted to block flow of hydraulic fluid therethrough in a first position and to allow hydraulic fluid to flow therethrough to tank in a second position.

9. The surface pumping unit of claim 8, wherein said phase programming means includes a cam connected to said pump rod lift means and said bleed valve is actuated by said cam.

10. Apparatus for lifting and lowering a well pump rod, comprising:

pump rod lift means adapted to attach to and pull upwardly on a well pump rod;

a hydraulic connected to said pump rod lift means for reciprocating said pump rod lift means upwardly and downwardly; and a valve having a switchable spool with five fluid flow control positions, including a center position configured to direct fluid pressure to both the rod end and the blind end of the hydraulic cylinder simultaneously while prohibiting fluid flow from the cylinder to tank, an extreme right position configured to direct fluid pressure to the rod end of the cylinder while allowing fluid to flow from the blind end of the cylinder to tank, an intermediate right position between said center and extreme right positions configured to maintain fluid pressure on the rod end of the cylinder while prohibiting fluid escape from the blind end of the cylinder, an extreme left position configured to direct fluid pressure to the blind end of the cylinder while allowing fluid flow from the rod end of the cylinder to tank, and an intermediate left position between said center and extreme left positions configured to maintain fluid pressure of said blind end of said cylinder while prohibiting fluid escape from the rod end of the cylinder.

11. The apparatus of claim 10, wherein the cross-sectional area of the rod of the cylinder is one half the surface area of the piston of the cylinder.

12. The apparatus of claim 10, including phase program means sensitive to the physical position of said pump rod lift means for switching said valve means from an up stroke phase to a down stroke phase and visa versa.

13. The apparatus of claim 12, wherein said phase program means is adjustable to selectively effect longer and shorter upstrokes and down strokes.

14. The apparatus of claim 13, including hydraulic pump means for supplying hydraulic fluid under pressure to said hydraulic cylinder.

15. The apparatus of claim 14, wherein the fluid output rate of said hydraulic pump means is adjustably variable for effecting selective increase or decrease in the speed of said upstroke and down stroke cycles.

16. The apparatus of claim 15, including fluid tank and cooling means for storing and cooling hydraulic fluid, said tank and cooling means including two reservoir portions a spaced distance apart from each other with cooling tubes extending therebetween in fluid communication with both of said reservoir portions, and overflow means between said two reservoir portions for allowing fluid to flow from one of said reservoir portions to the other in the event said cooling tubes are ineffective to conduct the fluid from one reservoir portion to the other.

17. The apparatus of claim 10, wherein said valve means is pilot actuated by hydraulic fluid pressure to shift from one position to another.

18. The apparatus of claim 17, including a left pilot actuator cylinder for shifting said spool to the right and a right pilot actuator cylinder for shifting said spool to the left, the normal range of operation being for the spool to shift from the extreme right position through the intermediate right center, and intermediate left positions to the extreme left position and visa versa, and said valve means including an adjustable stop for limiting rightward shifting of said spool in such a manner that said spool can only shift from the extreme right position through the intermediate right position to the center position and visa versa.

19. The apparatus of claim 18, wherein said phase program means includes upper bleed means for bleeding pressure from the right pilot actuator cylinder and lower bleed means for bleeding pressure from the left pilot actuator cylinder.

20. The apparatus of claim 19, wherein said phase program means includes a cam rod connected to said pump rod lift means and having an upper cam and a lower cam mounted thereon in spaced apart relation to each other and adapted to reciprocate in up and down motion corresponding to the up and down strokes of the pump lift means, said upper cam being adapted to actuate said upper bleed means to bleed pressure from said right pilot actuator cylinder and said lower cam being adapted to actuate said lower bleed means to bleed pressure from said left pilot actuator cylinder.

21. The apparatus of claim 20, wherein the distance between said upper and lower cams on said cam rod is adjustable.

22. The apparatus of claim 21, including pressure indicator means for measuring and indicating fluid pressure in the rod end and in the blind end of the hydraulic cylinder.

23. The apparatus of claim 22, including an adjustable minute flow control valve adapted to limit the rate of return flow of fluid from the hydraulic cylinder to tank to effect a slow let down stroke of said pump rod lift means.

24. The apparatus of claim 23, including fluid shock absorber means connected to said hydraulic cylinder to dampen shock forces resulting from stroke direction reversals during operation.

25. The apparatus of claims 10 or 24, wherein said pump rod lift means includes a cross beam pivotally mounted on a frame to oscillate in a rocking motion up and down in a vertical plane about a horizontal axis, one end of said cross beam being adapted to attach to and pull upwardly on a well pump rod.

26. The apparatus of claim 25, wherein said hydraulic cylinder is connected to said cross beam.

27. The apparatus of claim 26, including a shock absorber connector pin for connecting the cylinder to the cross beam, said shock absorber connector pin being comprised of an inner sleeve positioned concentrically inside a larger outer sleeve and a resilient material positioned in the annular space between said inner and outer sleeves.

28. The apparatus of claim 27, wherein said resilient material is bonded to the inside surface of said outer sleeve and to the outside surface of said inner sleeve.

29. The apparatus of claim 26, including longitudinally adjustable counter weights positioned on the end of said cross beam opposite the end adapted for attachment to the well pump rod.

* * * * *

UNITED STATES PATENT AND TRADEMARK OFFICE

CERTIFICATE OF CORRECTION

PATENT NO. : 4,449,896

DATED : May 22, 1984

INVENTOR(S) : Robert Klepper, Daryld W. Bomar

It is certified that error appears in the above-identified patent and that said Letters Patent is hereby corrected as shown below:

Column 5, line 35, delete "tanks" and substitute --tank--.
Column 10, line 13, delete "frome" and substitute -- frame--.
Column 11, line 4, delete "hydraulid" and substitute -- hydraulic--.
Column 11, line 17, delete "74" and substitute --75--.
Column 11, line 21, after "tion", insert --71--.
Column 12, line 53, delete "distruc-" and substitute --destruc- --.
Column 13, line 36, after "fluid", insert --138--.
Column 13, line 68, delete "conponents" and substitute --components--.
Column 14, line 7, delete "and" and substitute --or--.

Column 16, line 64, after "pump", insert --rod--.

Signed and Sealed this

*Nineteenth* Day of *February 1985*

[SEAL]

*Attest:*

DONALD J. QUIGG

*Attesting Officer* *Acting Commissioner of Patents and Trademarks*